US006850010B1

(12) United States Patent
Barry et al.

(10) Patent No.: US 6,850,010 B1
(45) Date of Patent: Feb. 1, 2005

(54) MICROWAVE POWERED LAMP WITH RELIABLE DETECTION OF BURNED OUT LIGHT BULBS

(75) Inventors: Jonathan D. Barry, Frederick, MD (US); Keith A. Helms, Rockville, MD (US)

(73) Assignee: Fusion UV Systems, Inc., Gaithersburg, MD (US)

( * ) Notice: Subject to any disclaimer, the term of this patent is extended or adjusted under 35 U.S.C. 154(b) by 0 days.

(21) Appl. No.: 10/619,419

(22) Filed: Jul. 16, 2003

(51) Int. Cl.[7] ..... H01J 25/50

(52) U.S. Cl. ..... 315/39.51; 315/85; 315/248; 315/129

(58) Field of Search ..... 315/34, 39.51, 315/85, 248, 344, 267, 39, 129

(56) References Cited

U.S. PATENT DOCUMENTS

| | | | | |
|---|---|---|---|---|
| 2,498,719 A | | 2/1950 | Spencer | 333/17.1 |
| 2,498,720 A | | 2/1950 | Wild et al. | 333/17.1 |
| 2,679,595 A | | 5/1954 | Spencer | 331/62 |
| 3,412,227 A | | 11/1968 | Anderson | 219/709 |
| 5,399,977 A | | 3/1995 | Yoshizako et al. | 324/645 |
| 5,811,936 A | * | 9/1998 | Turner et al. | 315/39 |
| 5,847,517 A | * | 12/1998 | Ury et al. | 315/248 |
| 5,866,990 A | * | 2/1999 | Ury et al. | 315/248 |
| 6,445,138 B1 | * | 9/2002 | Barry et al. | 315/248 |
| 6,617,806 B2 | * | 9/2003 | Kirkpatrick et al. | 315/248 |
| 6,661,183 B2 | * | 12/2003 | Park et al. | 315/248 |
| 2003/0057841 A1 | * | 3/2003 | Kang | 315/39 |

FOREIGN PATENT DOCUMENTS

| | | |
|---|---|---|
| JP | 61-248354 | 5/1986 |
| JP | 8-96981 | 12/1996 |

* cited by examiner

*Primary Examiner*—Thuy Vinh Tran
(74) *Attorney, Agent, or Firm*—Antonelli, Terry, Stout & Kraus, LLP

(57) ABSTRACT

The invention is a microwave powered lamp (10). The lamp includes a light reflective cavity (28); an electrodeless bulb (16) contained in the light reflective cavity (26) from which light is emitted when the electrodeless bulb is excited by microwaves; a magnetron (12) for providing the microwaves for exciting the electrodeless bulb; a waveguide (14) which couples the microwaves emitted by the magnetron to the light reflective cavity for exciting the electrodeless bulb; a housing (22) which contains the lamp; a detector (102, 202) disposed within the housing, which detects the microwaves which are not coupled to the bulb during operation of the magnetron and outputs a signal indicative of a level of received microwaves; and a magnetron control (300), coupled to the detector, which causes the magnetron to be turned off when a level of the signal indicates the level of received microwaves exceeds a threshold.

32 Claims, 8 Drawing Sheets

MICROWAVE POWERED LAMP WITH RELIABLE DETECTION OF BURNED OUT LIGHT BULBS

BACKGROUND OF THE INVENTION

1. Field of the Invention

The present invention relates to microwave powered lamps and more specifically, to microwave powered lamps having reliable detection of bulb failure or degrading of performance.

2. Description of the Prior Art

FIG. 1 illustrates a prior art microwave powered lamp 10 of the type sold by the Assignee of the present invention and as described in the Assignee's U.S. Pat. No. 6,445,138 which is incorporated herein by reference in its entirety. The microwave-powered lamp may be used to produce ultraviolet (UV) or visible light depending on the application such as, but not limited to, curing surface coatings. A magnetron 12 provides microwaves transmitted through a microwave cavity/waveguide 14 to a microwave excited bulb 16 which outputs light, as stated above, in either the UV or visible spectrum depending upon the application. An air source 18 blows air 20 through a housing 22 which contains the magnetron 12, microwave cavity/waveguide 14, and microwave excited bulb 16. As indicated, air 20 flows through the housing around the magnetron 12 to provide cooling thereof and into the microwave cavity/waveguide 14 into and around the bulb 16 to provide cooling of the bulb. The lamp housing 22 is designed to channel air 20 in contact with cooling fins 23 of the magnetron 12 through openings 24 and then through openings (not illustrated) in the reflector 26 past the bulb 16 as described above and out of the housing 22. The air 20, which is heated by the magnetron 12 and the bulb 16, exits through the opening 29 which is covered by a microwave retaining screen (not illustrated) through which the light is outputted after being reflected by a light reflective cavity 28.

The magnetron 12 is subject to damage if the light bulb 16 becomes inoperative. An assembly of a photocell 32 and an associated circuit 33, which senses variation in the resistance of the photocell that detects light 34 emitted from the bulb 16 passing through an opening in the reflector 28 to contact the photocell, is used to detect an inoperative bulb. The resistivity of the photocell 32 changes, which is sensed by the associated circuit 33, to produce a control signal which is applied to the magnetron controller (not illustrated). The magnetron controller functions, when the photocell indicates that light is not being received, to disconnect the electrical power from the magnetron 12 to thereby turn it off.

A typical microwave-powered UV lamp is six or ten inches in length and incorporates one or more magnetrons 12, as illustrated in FIGS. 1 and 2, to provide microwave power to excite a bulb 16. When the lamp 10 is first turned on, there is a high voltage standing wave ratio (VSWR) seen by the magnetron 12 because the bulb 16 is cool and the impedance of the bulb at the microwave frequency is not well matched. As the bulb 16 warms up, the VSWR gradually decreases to a steady state value as illustrated in FIG. 8. High VSWR transients are a normal part of starting ignition of a plasma-filled bulb 16. During the transient period, it is possible for arcing to occur in the microwave cavity/waveguide 14 which can destroy the magnetron. The magnetron may also experience severe anode dissipation during the transient period.

If there is no protection provided by the photocell 32 and protection circuit 33, the VSWR will remain unacceptably high until the magnetron is destroyed. The power supply (not illustrated) of the magnetron 12 applies high voltage to the magnetron. The magnetron controller is responsive to a signal from the protection circuit 33. If no signal is received indicating ignition within a set period of time, the magnetron controller assumes the bulb has failed to ignite and cuts electrical power to protect the magnetron 12 given the fault condition indication of no ignition.

The use of a photocell 32 and protection circuit 33 is subject to being unable to distinguish between light 34 from the bulb 16 and stray ambient light which enters the housing 22 from other sources. The presence of ambient light may result in the photocell 32 and protection circuit 33 sensing the ambient light from another source as an indication that the bulb has ignited. If in fact the bulb 16 has not ignited, damage to the magnetron 12 will occur by its continuing to provide output power the bulb 16 which is not absorbed by the plasma therein. Furthermore, the photocell 32 and control circuit 33 may fail requiring repair resulting in costly downtime for any system relying upon the operation of the microwave powered lamp and furthermore, if repair is not made, the probability of the magnetron 12 being permanently damaged by power being applied thereto is high.

SUMMARY OF THE INVENTION

The present invention is a microwave powered lamp and method of control of a microwave powered lamp. The present invention replaces the prior art photocell and control circuit with a detector which is disposed within the housing of the microwave powered lamp which detects microwaves which are not coupled to the microwave excited lamp during operation of the magnetron and outputs a signal indicative of a level of received microwaves. A magnetron control is coupled to the detector which causes the magnetron to be turned off when a level of the detected signal indicates that the level of received microwaves exceeds a threshold. Since ignition of the microwave powered bulb represents an electrical load to the magnetron, the resultant level of microwave energy received by the detector, whether inside the microwave cavity/waveguide or inside the microwave housing, drops. The sensed microwave energy during normal bulb operation is below a level associated with non-ignition of the bulb such as that caused by bulb failure. A set period of time is allowed for the level of the detected microwaves to stabilize to avoid turning off of the magnetron power supply during transient voltage swings that occur during the first turning on of the bulb which otherwise might provide a false triggering signal turning off the magnetron power supply. With the invention, the sensing of the ignition condition (either on or off) of the bulb occurs reliably much more rapidly than with the prior art photocell and control circuit.

Additionally, the reliable detection of a non-ignition condition allows the power to be removed quickly from the magnetron long before any damage occurs from power not being absorbed by the plasma in bulb. This removes high stress and thermal loading of the magnetron as a result of the microwave output not being absorbed by the plasma in the bulb.

Additionally, the presence of ambient light within the housing of the microwave-powered lamp does not produce false indications of bulb ignition as with the prior art.

The invention is a microwave powered lamp. A microwave powered lamp in accordance with the invention includes a light reflective cavity; an electrodeless bulb contained in the light reflective cavity from which light is emitted when the electrodeless bulb is excited by microwaves; a magnetron for providing the microwaves for exciting the electrodeless bulb; a waveguide which couples the microwaves emitted by the magnetron to the light reflective cavity for exciting the electrodeless bulb; a housing which contains magnetron and the waveguide; a detector disposed within the housing or the waveguide, which detects the microwaves which are not coupled to the bulb during operation of the magnetron and outputs a signal indicative of a level of received microwaves; and a magnetron control, coupled to the detector, which causes the magnetron to be turned off when a level of the signal indicates the level of received microwaves exceeds a threshold indicative of the bulb not being ignited. The detector may comprise an electrical field probe disposed in the waveguide at a location which produces a response to microwaves not coupled to the bulb sufficient to detect when the bulb is not ignited during magnetron operation and the magnetron control may be a control circuit which produces a control signal for turning off the magnetron by removing electrical power from the magnetron when the threshold is exceeded. The electrical field probe may be located at an electrical field maximum in the waveguide. The detector may comprise an antenna located within the housing which receives spurious microwaves leaking from any of at least one of the magnetron, waveguide or light reflective cavity which produces a response to the spurious microwaves sufficient to detect when the electrodeless bulb is not ignited during magnetron operation and the magnetron control may be a control circuit which produces a control signal for turning off the magnetron by removing electrical power from the magnetron when the threshold is exceeded. The magnetron control may comprise a power supply of the magnetron and the electrical power from the power supply to the magnetron may be reduced or turned off when the signal indicates the level of received microwaves exceeds the threshold for a set period of time.

The invention is also a method of control of a microwave powered lamp. A method of control of a microwave powered lamp includes a light reflective cavity, an electrodeless bulb contained in the light reflective cavity from which light is emitted when the electrodeless bulb is excited by microwaves, a magnetron for providing the microwaves for exciting the electrodeless bulb, a waveguide which couples microwaves emitted by the magnetron to the light reflective cavity for exciting the electrodeless bulb, a housing which contains the magnetron and the waveguide, a detector disposed within the housing or the waveguide which detests microwaves which are not coupled to the bulb during operation of the magnetron and a magnetron control coupled to thia detector for controlling activation of the magnetron comprises providing a signal from the detector indicative of a level of detected microwaves; and the magnetron control reduces power to the magnetron when a level of the signal indicators the level of the detected microwaves exceeds a threshold indicative of the bulb not being ignited. The detector may comprise an electrical field probe disposed in the waveguide at a location which produces a response to microwaves not coupled to the bulb sufficient to detect when the bulb is not ignited during magnetron operation and the magnetron control may be a control circuit which produces a control signal for turning off the magnetron by removing electrical power from the magnetron when the threshold is exceeded. The electrical field probe may be located at an electrical field maximum in the waveguide. The detector may comprise an antenna located within the housing which receives spurious microwaves leaking from any of at least one of the magnetron, waveguide or light reflective cavity which produces a response to the spurious microwaves sufficient to detect when the electrodeless bulb is not ignited during magnetron operation and the magnetron control may be a control circuit which produces a control signal for turning off the magnetron by removing electrical power from the magnetron when the threshold is exceeded. The magnetron control may comprise a power supply of the magnetron and the electrical power from the power supply to the magnetron may be reduced or turned off when the signal indicates the level of received microwaves exceeds the threshold for a set period of time.

BRIEF DESCRIPTION OF THE DRAWINGS

Like reference numerals identify like parts throughout the drawings.

DESCRIPTION OF THE PREFERRED EMBODIMENTS

Figure 1:
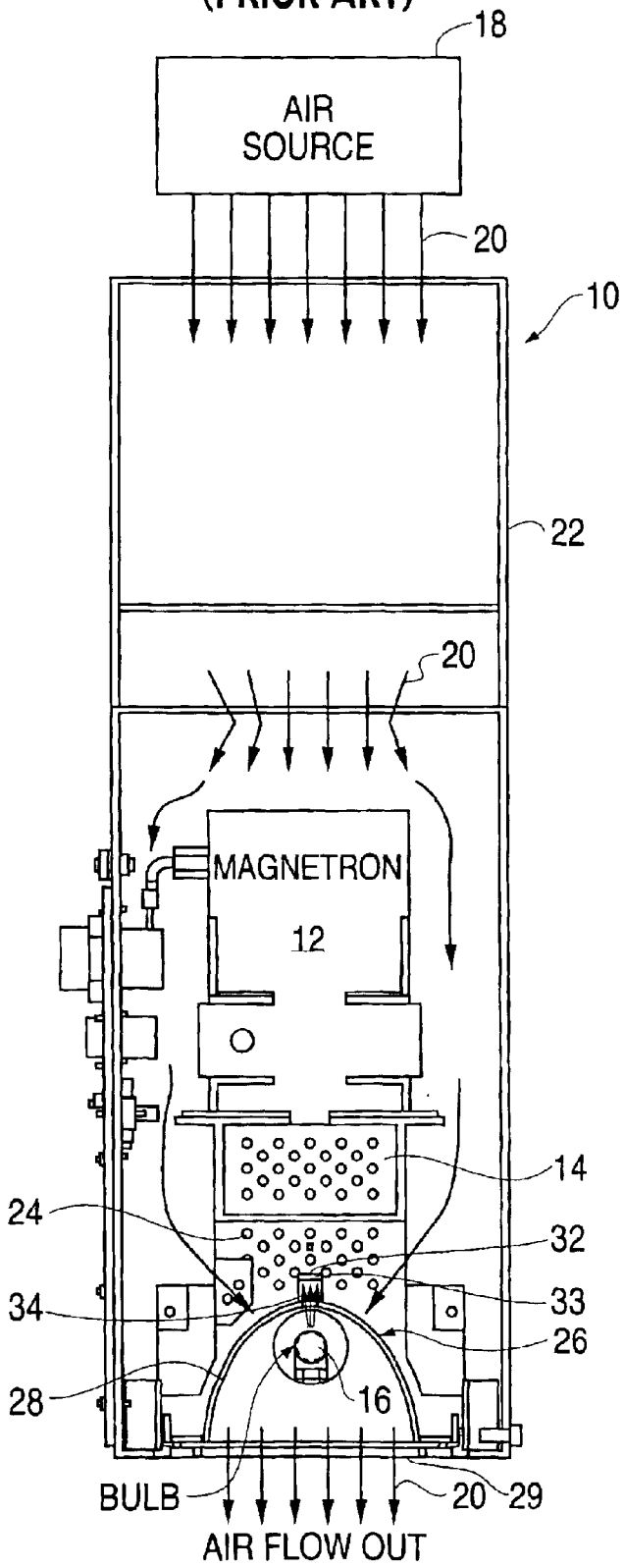
FIG. 1 (PRIOR ART)
FIGS. 1 and 2 respectively illustrate a side and front elevational view of a prior art microwave powered lamp of the type manufactured by the Assignee of the present invention.
Figure 2:
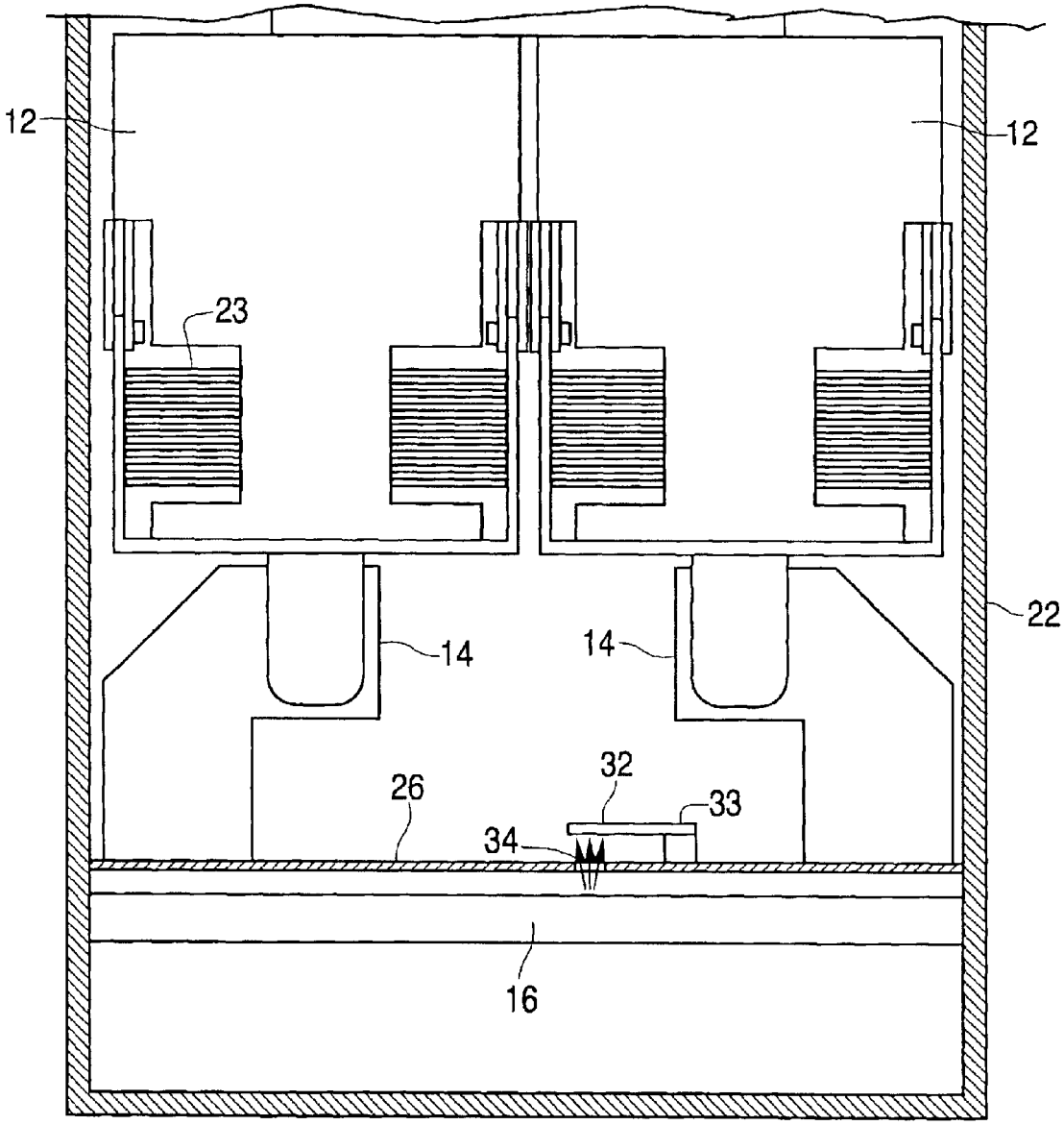
FIG. 2 (PRIOR ART)
Figure 3:
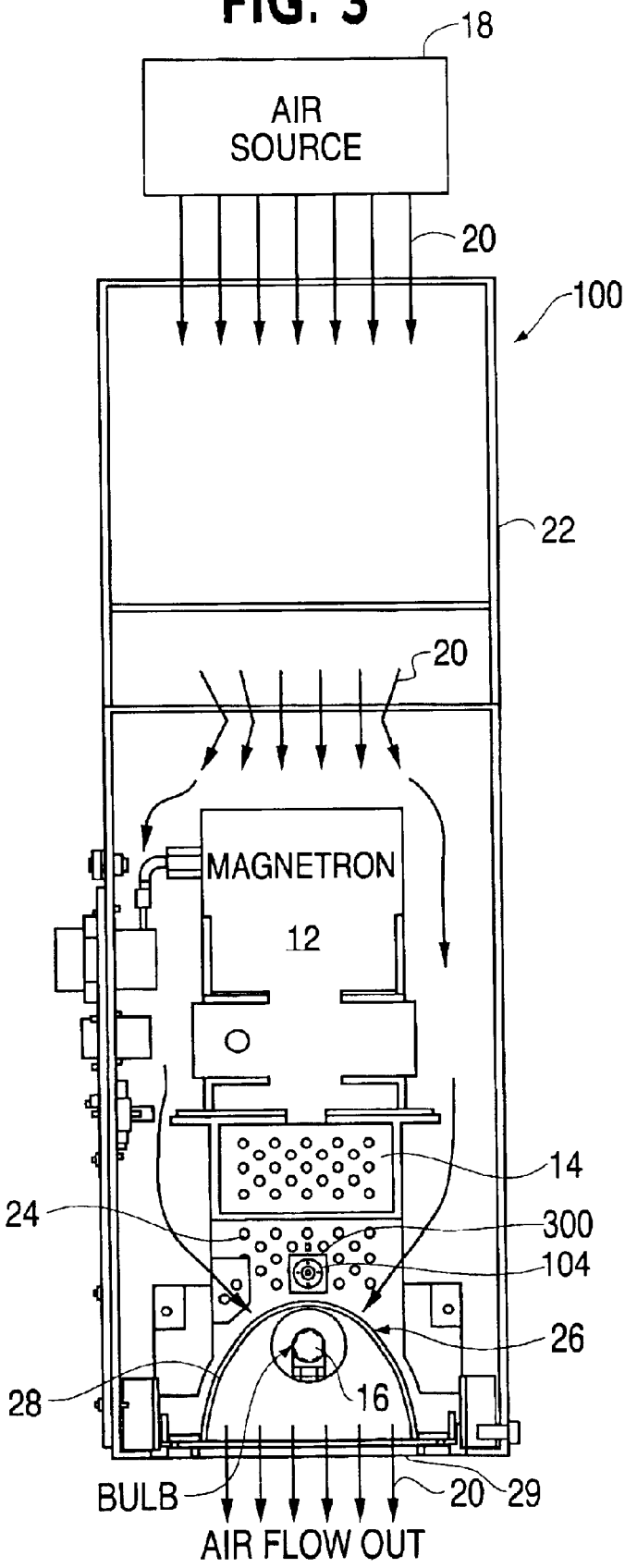
FIG. 3 illustrates a side elevational view of a first embodiment of the present invention.
Figure 4:
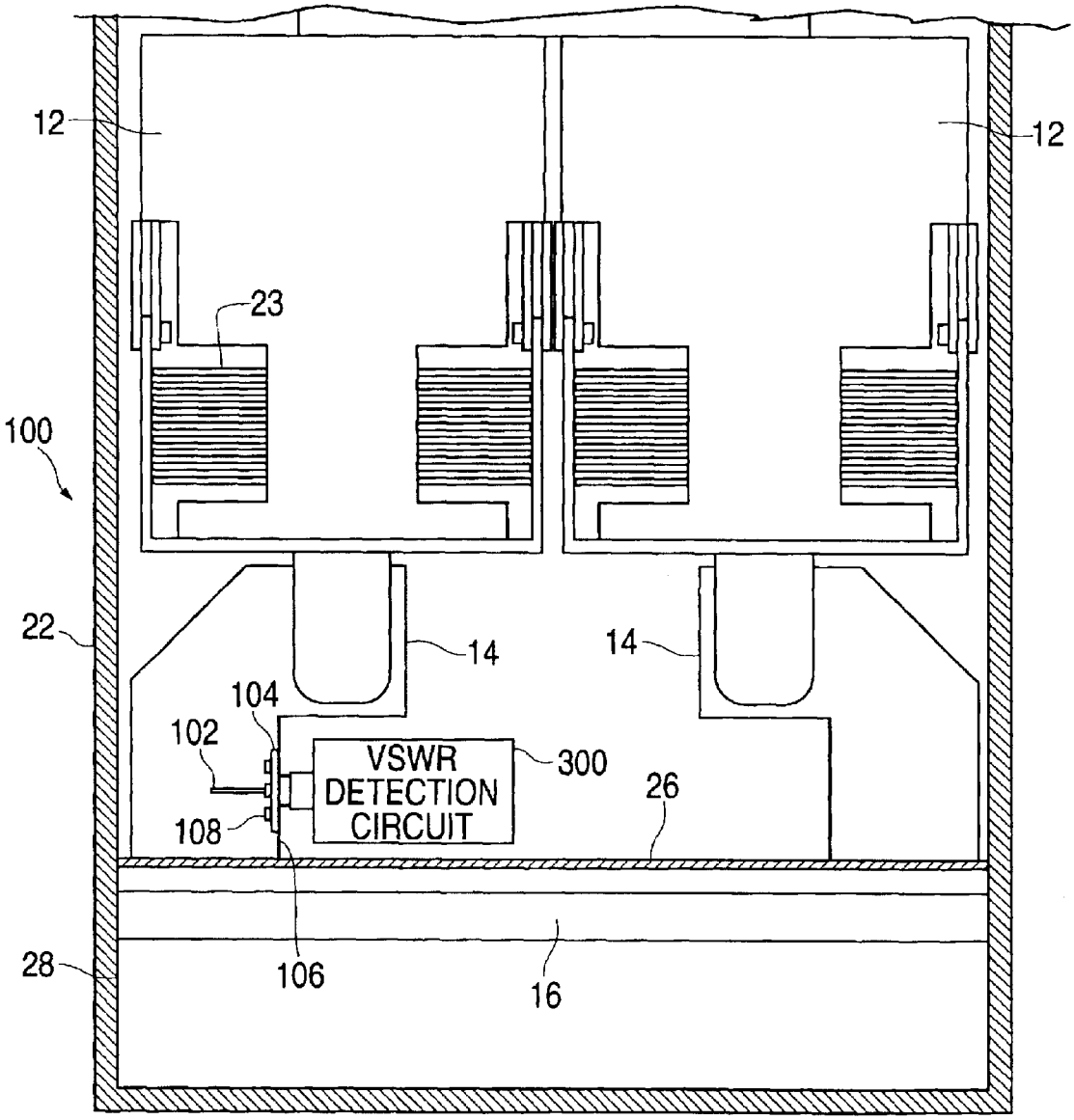
FIG. 4 illustrates a front elevational view of the first embodiment of the present invention.
Figure 5:
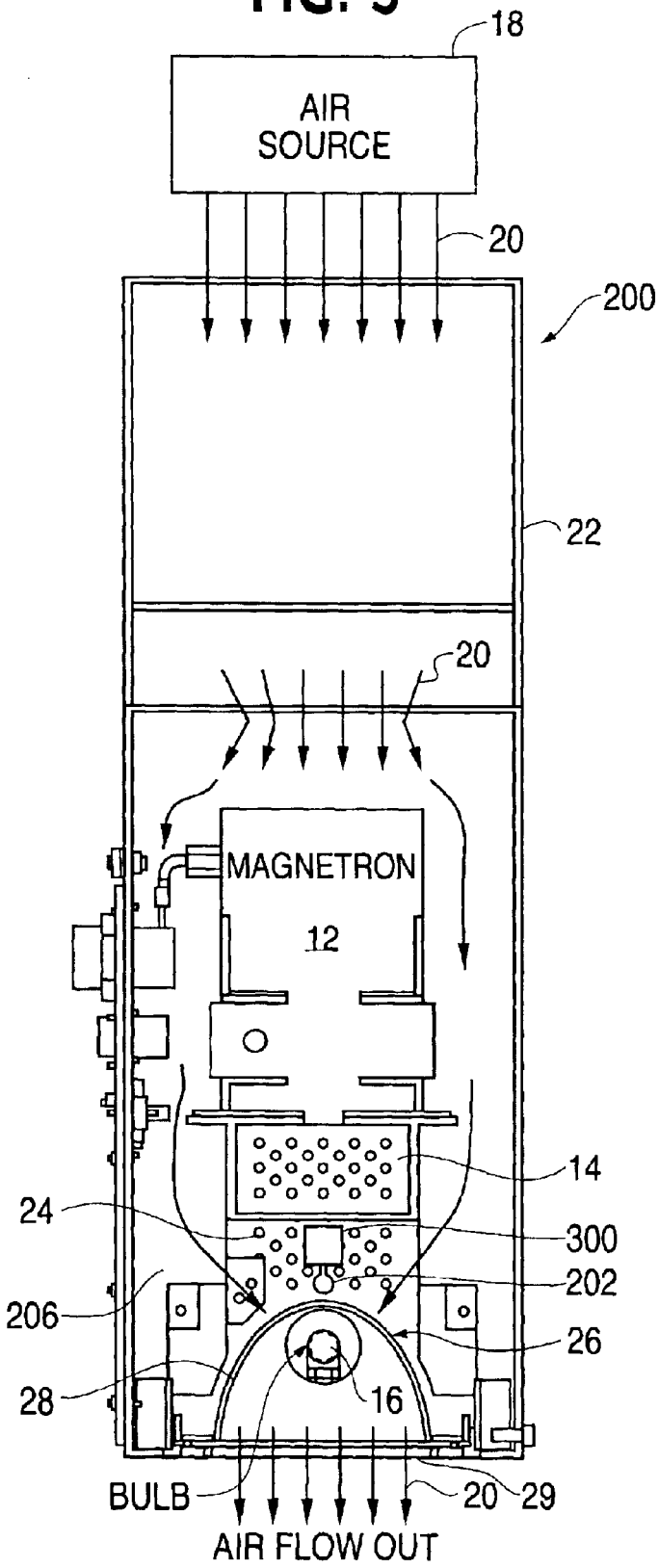
FIG. 5 illustrates a side elevational view of a second embodiment of the present invention.
Figure 6:
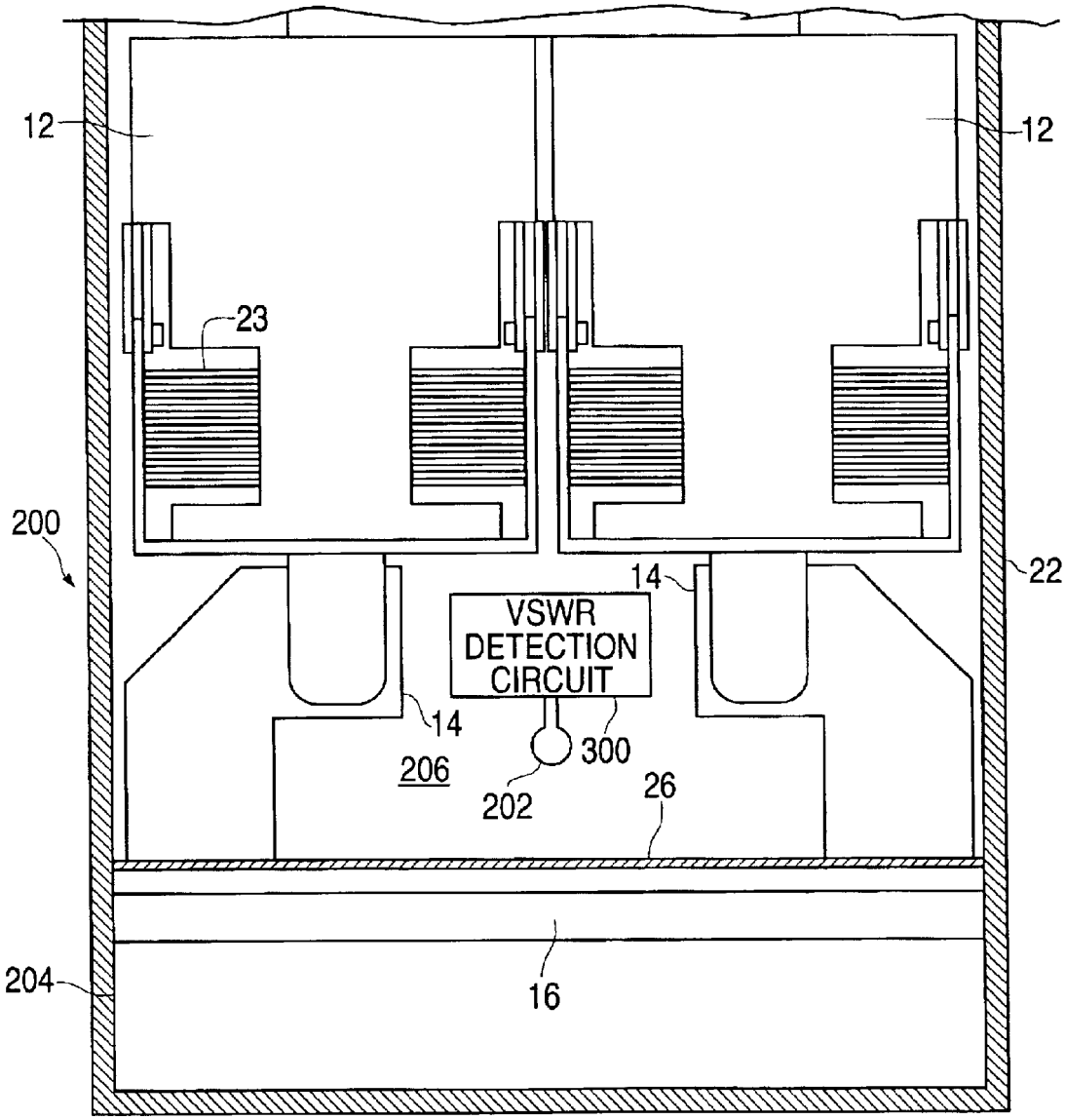
FIG. 6 illustrates a front elevational view of the second embodiment of the present invention.

The present invention may be practiced in numerous microwave powered lamp designs with one acceptable design being the prior art microwave powered lamp design illustrated in FIGS. 1 and 2 as discussed in conjunction with first and second embodiments 100 and 200 respectively illustrated in FIGS. 3 and 4 and 5 and 6. With the invention the photocell 32 and control circuit 33 of the prior art are replaced with a microwave detector which is located within the microwave cavity/waveguide 14 or within the housing 22 of a microwave powered lamp 100 or 200 as respectively illustrated in FIGS. 3 and 4 and 5 and 6. The detector location in the housing may be with the detector extending into the microwave cavity/waveguide 14 where the VSWR is sensed, as illustrated in the embodiment 100 in FIGS. 3 and 4, or external to the microwave cavity/waveguide 14 but within the housing 22, as illustrated in FIGS. 5 and 6. In the first embodiment 100, as illustrated in FIGS. 3 and 4, a microwave probe 102 extends into the microwave cavity/waveguide 14 and in the second embodiment, illustrated in FIGS. 5 and 6, a loop antenna 202 receives spurious microwaves leaking from any of the at least one of the magnetron 12, microwave cavity/waveguide 14 or light reflective cavity 204 of the second embodiment 200 of FIGS. 5 and 6. As illustrated in FIGS. 3 and 4, the light reflective cavity 28 is external to the housing 28 and, as illustrated in FIGS. 5 and 6, the light reflective cavity 204 is external to the housing 22.

Figure 7:
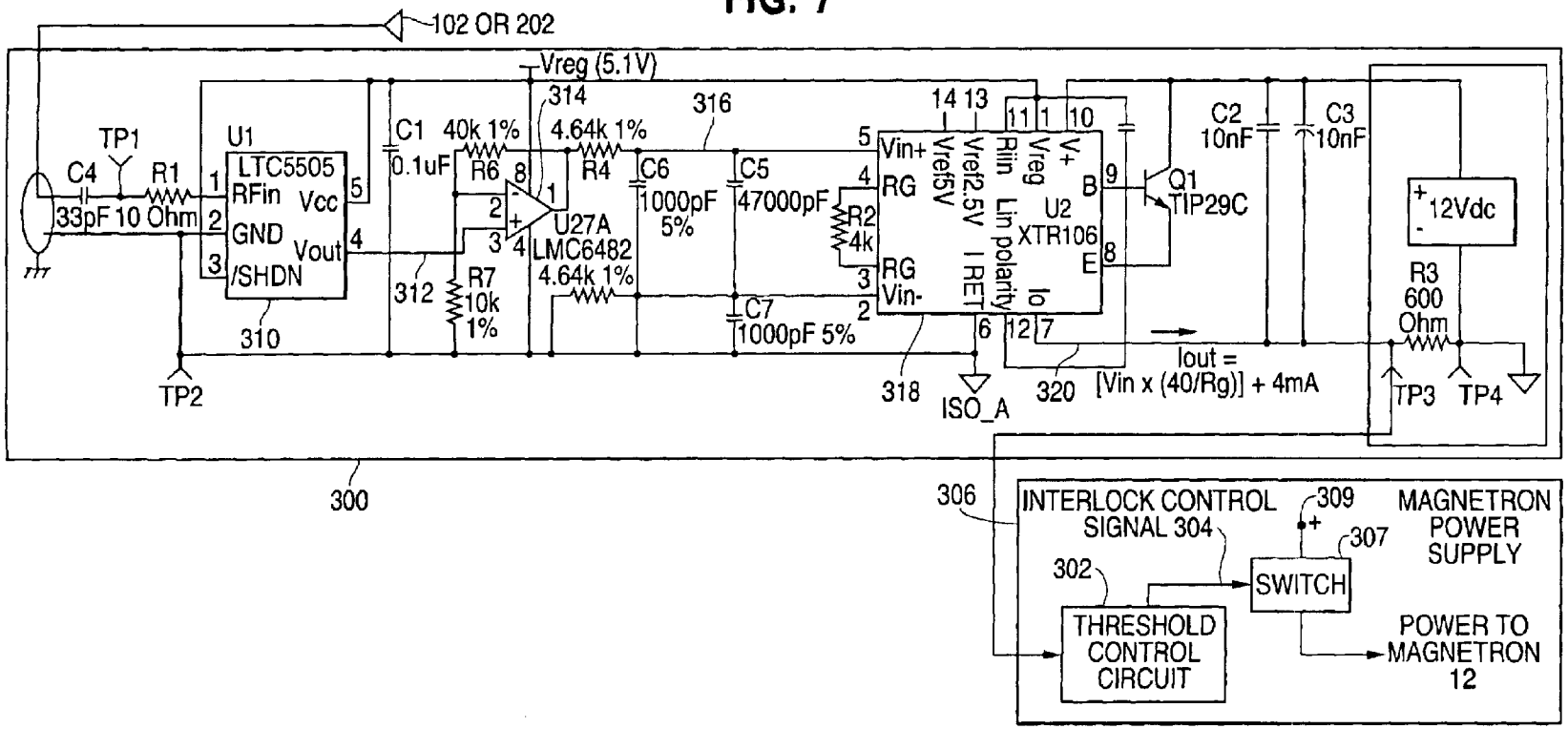
FIG. 7 illustrates a VSWR detection circuit used for generating a signal indicative of the operational state of the ignition of an electrodeless bulb in accordance with the present invention.

In each embodiment, the detected microwaves, whether detected from within the microwave cavity/waveguide 14 or within the housing 22, are processed by a VSWR detection circuit 300, which may be in accordance with the design of FIG. 7, that performs microwave detection and provides a variable current, such as, but not limited to between a 4 to 20 milliamps range which drives a threshold control circuit 302 to produce an INTERLOCK CONTROL SIGNAL 304 which is applied to the magnetron power supply 306. The INTERLOCK CONTROL SIGNAL turns off the magnetron 12 when the microwave signal detected by the microwave probe 102 or loop antenna 202 or other detector design rises above a threshold as described in detail below with respect to FIG. 8 for longer than a set time interval. The set interval may be less than one second during which the effect of transient VSWR variation subsides to a condition reflecting normal ignition of the electrodeless bulb 16.

In the embodiment of FIGS. 3 and 4, the microwave probe 102 is associated with the VSWR detection circuit 300 of FIG. 7. The flange 104 is attached to the sidewall 106 of the waveguide microwave cavity 14 by suitable connectors 108. The microwave probe functions as a E (electrical) field detector and is preferably located at an electrical field maximum in the microwave cavity/waveguide 14. The location of the microwave probe 102 may be disposed at other locations than at an electrical field maximum within the microwave cavity/waveguide 14 but location at a E field maximum enhances the detected voltage.

The second embodiment 200 of the invention in FIGS. 5 and 6 functions in the same manner as the first embodiment with the difference being that the VSWR detection circuit 300 is mounted on one of the internal sidewalls 206 of housing 22 at a location where sufficient spurious microwave energy, which leaks from the microwave cavity/waveguide 14, light reflective cavity 204 or magnetron 12, is detected if the bulb 16 is ignited. When proper bulb operation occurs, the loading of the output from the magnetron 12 keeps the signal level produced by the VSWR detection circuit 300 below a threshold as discussed below in conjunction with FIG. 8. The signal level produced by the VSWR detection circuit 300 below the threshold results in the INTERLOCK CONTROL SIGNAL 304 as illustrated in FIR. 8 being applied from the threshold control circuit 302 to the magnetron power supply 306 not turning off the magnetron power supply.

Figure 8:
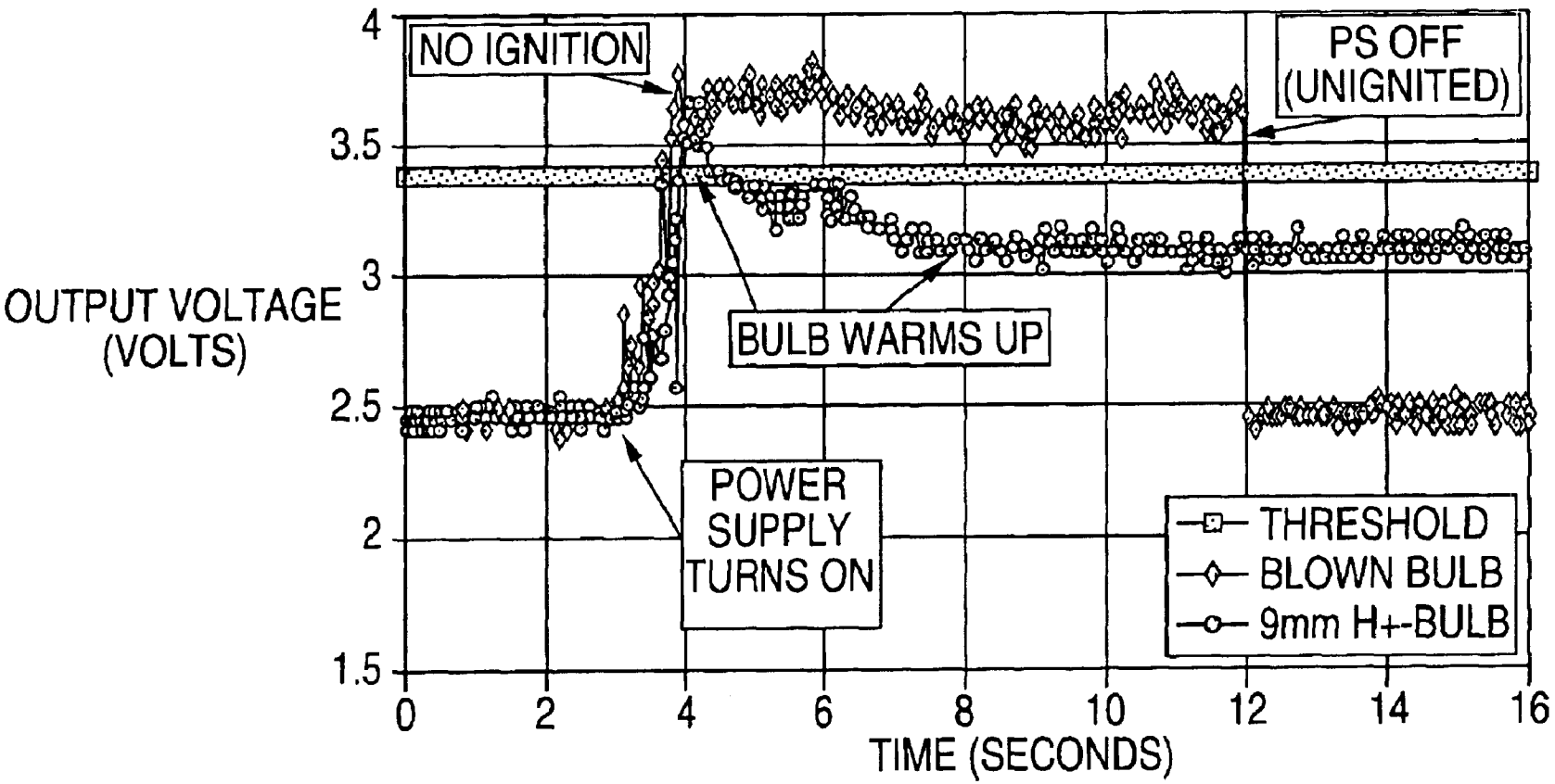
FIG. 8 illustrates operational data obtained from operation and failure of a 9 mm H+ bulb of the Assignee utilizing the circuit of FIG. 7.

FIG. 7 illustrates an embodiment of a VSWR detection circuit 300 which may be used with the practice of the present invention. The E field probe 102 and loop antenna 202 are illustrated, but it should be understood that the present invention is not limited to any type of a microwave detector. The E field probe 102 or loop antenna 202 produces a very small voltage signal representative of the level of detected microwaves either within the microwave cavity/waveguide 14 or within the housing 22. The small voltage signal produced by the E field probe 102 or loop antenna 202 is coupled by coupling capacitor C4 and resistor R4 to an integrated circuit 310 which amplifies the small voltage signal input into an output signal 312 which may have a voltage range between 300 and 1,000 millivolts. The output signal 312 is applied to operational amplifier 314 which produces a further output voltage gain. Signal 316 has sufficient gain to drive a voltage to constant current converting integrated circuit 318. The output signal 320 produced by the voltage to current converting integrated circuit 318 produces a constant current output which is not effected by line drop which may be resultant from the coupling of the output signal to a remote magnetron power supply 306 which contains a threshold control circuit 302. The output signal 320 is coupled to the threshold control circuit 302, which as discussed above, detects if the voltage sensed by the E field probe 102 or loop antenna 202 is above a threshold which is indicative of a signal level representing failure of the electrodeless bulb 16. Failure causes the VSWR signal, after transients have subsided as the result of the initial turning on of the magnetron 12, to reach a steady state level indicative of an unacceptably high VSWR ratio being present either within the microwave cavity/waveguide 14 or spurious microwave leakage of sufficient magnitude being within the housing 22. The threshold control circuit 302 senses if the output signal 320 is above a set threshold level, as illustrated in FIG. 8, for a time period chosen to be representative of when steady state operation occurs during normal operation of the microwave powered lamp which period may be, as illustrated in FIG. 8, a fraction of a second or longer. The threshold control circuit 302 produces an INTERLOCK, CONTROL SIGNAL 304 which has one of two levels which respectively close and open a switch 307 which is indicated schematically and in practice may be any typo of switching device that controls connection of the high voltage potential 309 to the magnetron 12. The first level is indicative of the electrodeless bulb 16 representing a proper electrical load to the magnetron 12 which causes swatch 307 to be in a closed state and the second level which causes the switch to be in an open state is indicative of failure of the electrodeless bulb 16 which causes the VSWR within the microwave cavity/waveguide 14 or housing 22 to be unacceptably high. The second level signal causes the magnetron power supply 306 to be turned off as an interlock function of the magnetron power supply.

FIG. 8 illustrates the operation of the present invention with a 9 mm H+ bulb of the Assignee in a microwave powered lamp such as that illustrated in FIGS. 3 and 4. As is seen, at approximately 3 seconds, the power supply 306 is turned on which causes the magnetron 12 to produce microwaves which excite the electrodeless bulb 16 and produce standing waves within the microwave cavity/waveguide 14 which rapidly ramp up in level. As indicated in the key in the bottom right-hand corner of FIG. 8, the threshold control circuit 302 senses when the output signal 320 reaches the threshold level of approximately 3.4 volts. As indicated with proper operation of the 9 mm. H+bulb, as identified by the curve composed of small circles, when the bulb is warming up the signal level fluctuates and actually exceeds the threshold for a small period of time. Thereafter the voltage stabilizes below the threshold value which causes the INTERLOCK CONTROL SIGNAL 304 to be at the first level which permits the magnetron power supply 306 to continue to apply power to the magnetron 12. However, in the situation where the 9 mm H+ bulb is blown, as indicated by the curve composed of small diamonds, the output voltage of the signal 320 rises in a steady state above the threshold.

While a time lapse of almost 8 seconds is shown in FIG. 8, which is representative of the time lapse which is built into the prior art, photocell 32 and circuit detector 33 in order to indicate the failure of a bulb, in fact a reliable indication of bulb failure may be obtained much earlier. This time lapse may be from a half to one second since from the period of reaching the initial level above the threshold in view of a steady state output voltage of the signal 320 being reached in that time frame. At that point (while a much longer time period of approximately 8 seconds was allowed to elapse) the second level of the INTERLOCK CONTROL SIGNAL 304 may be used to turn off the magnetron power supply 306. The time lag and the threshold level are design parameters of the particular circuits and E field probe 102 or loop antenna 202 or other detectors which may be used for sensing the VSWR.

The present invention provides a reliable mechanism for detecting failure of an electrodeless bulb 16 which is indicated by a sensed unacceptably high detected VSWR ratio within the cavity 22 or within the microwave cavity/waveguide 14 and is not subject to false indications resulting from light from other light sources since the detection of a failed electrodeless bulb is not dependent upon light detection.

While the invention has been described in terms of its preferred embodiments, it should be understood that numerous modifications may be made thereto without departing from the spirit and scope of the present invention. It is intended that all such modifications fall within the scope of the appended claims.

What is claimed is:

1. A microwave powered lamp comprising:

a light reflective cavity;

an electrodeless bulb contained in the light reflective cavity from which light is emitted when the electrodeless bulb is excited by microwaves;

a magnetron for providing the microwaves for exciting the electrodeless bulb;

a waveguide which couples the microwaves emitted by the magnetron to the light reflective cavity for exciting the electrodeless bulb;

a housing which contains the magnetron and the waveguide;

a detector disposed within the housing or the wave guide, which detects the microwaves which are not coupled to the bulb during operation of the magnetron and outputs a signal indicative of a level of received microwaves; and a magnetron control, coupled to the detector, which causes the magnetron to be turned off when a level of the signal indicates the level of received microwaves exceeds a threshold indicative of the bulb not being ignited.

2. A lamp in accordance with claim 1 wherein:

the detector comprises an electrical field probe disposed in the waveguide at a location which produces a response to microwaves not coupled to the bulb sufficient to detect when the bulb is not ignited during magnetron operation and the magnetron control is a control circuit which produces a control signal for turning off the magnetron by removing electrical power from the magnetron when the threshold is exceeded.

3. A lamp in accordance with claim 2 wherein:

the electrical field probe is located at an electrical field maximum in the waveguide.

4. A lamp in accordance with claim 3 wherein:

the magnetron control comprises a power supply of the magnetron and the electrical power from the power supply to the magnetron is reduced when the signal indicates the level of received microwaves exceeds the threshold for a set period of time.

5. A lamp in accordance with claim 4, wherein:

the light reflective cavity is external to the housing.

6. A lamp in accordance with claim 3 wherein:

the light reflective cavity is external to the housing.

7. A lamp in accordance with claim 2 wherein:

the magnetron control comprises a power supply of the magnetron and the electrical power from the power supply to the magnetron is reduced when the signal indicates the level of received microwaves exceeds the threshold for a set period of time.

8. A lamp in accordance with claim 7, wherein;

the light reflective cavity is external to the housing.

9. A lamp in accordance with claim 2 wherein:

the light reflective cavity is external to the housing.

10. A lamp in accordance with claim 1 wherein:

the detector comprises an antenna located within the housing which receives spurious microwaves leaking from any of at least one of the magnetron, waveguide or light reflective cavity which produces a response to the spurious microwaves sufficient to detect when the electrodeless bulb is not ignited during magnetron operation and the magnetron control is a control circuit which produces a control signal for turning off the magnetron by removing electrical power from the magnetron when the threshold is exceeded.

11. A lamp in accordance with claim 10 wherein:

the light reflective cavity is external to the housing.

12. A lamp in accordance with claim 10, wherein:

the magnetron control comprises a power supply of the magnetron and the electrical power from the power supply to the magnetron is reduced when the signal indicates the level of received microwaves exceeds the threshold for a set period of time.

13. A lamp in accordance with claim 12 wherein:

the light reflective cavity is external to the housing.

14. A lamp in accordance with claim 1 wherein:

the magnetron control comprises a power supply of the magnetron and electrical power from the power supply to the magnetron is reduced when the signal indicates the level of received microwaves exceeds the threshold for a set period of time.

15. A lamp in accordance with claim 14 wherein:

the light reflective cavity is external to the housing.

16. A lamp in accordance with claim 1 wherein:

the light reflective cavity is external to the housing.

17. A method of control of a microwave powered lam including a light reflective cavity, an electrodeless bulb contained in the light reflective cavity from which light is emitted when the electrodeless bulb is excited by microwaves, a magnetron for providing the microwaves for exciting the electrodeless bulb, a waveguide which couples microwaves emitted by the magnetron to the light reflective cavity for exciting the electrodeless bulb, a housing which contains the lamp, a detector disposed within the housing which detects microwaves which are not coupled to the bulb during operation of the magnetron and a magnetron control coupled to the detector for controlling activation of the magnetron comprising:

providing a signal from the detector indicative of a level of detected microwaves; and the magnetron control reduces power to the magnetron when a level of the signal indicates the level of the detected microwaves exceeds a threshold indicative of the bulb not being ignited.

18. A method in accordance with claim 17, wherein:

the detector comprises an electrical field probe disposed in the waveguide at a location which produces a response to microwaves not coupled to the bulb sufficient to detect when the bulb is not ignited during magnetron operation and the magnetron control is a control circuit which produces a control signal for turning off the magnetron by removing electrical power from the magnetron when the threshold is exceeded.

19. A method in accordance with claim 18 wherein:

the magnetron control comprises a power supply of the magnetron and the electrical power from the power supply to the magnetron is reduced when the signal indicates the level of received microwaves exceeds the threshold for a set period of time.

20. A method in accordance with claim 19 wherein:

the light reflective cavity is external to the housing.

21. A method in accordance with claim 18, wherein:

the electrical field probe is located at an electrical field maximum in the waveguide.

22. A method in accordance with claim 4 wherein:

the light reflective cavity is external to the housing.

23. A method in accordance with claim 21, wherein:

the magnetron control comprises a power supply of the magnetron and the electrical power from the power supply to the magnetron is reduced when the signal indicates the level of received microwaves exceeds the threshold for a set period of time.

24. A method in accordance with claim 23 wherein:

the light reflective cavity is external to the housing.

25. A method in accordance with claim 18 wherein:

the light reflective cavity is external to the housing.

26. A method in accordance with claim 17 wherein:

the detector comprises an electrical field probe disposed in the wave guide at a location which produces a response to microwaves not coupled to the bulb sufficient to detect when the bulb is not ignited during magnetron operation and the magnetron control is a control circuit which produces a control signal for turning off the magnetron by removing electrical power from the magnetron when the threshold is exceeded.

27. A method in accordance with claim 26 wherein:

the magnetron control comprises a power supply of the magnetron and the electrical power from the power supply to the magnetron is reduced when the signal indicates the level of received microwaves exceeds the threshold for a set period of time.

28. A method in accordance with claim 27 wherein:

the light reflective cavity is external to the housing.

29. A method in accordance with claim 26 wherein:

the light reflective cavity is external to the housing.

30. A method in accordance with claim 17 wherein:

the magnetron control comprises a power supply of the magnetron and electrical power from the power supply to the magnetron is reduced when the signal indicates the level of received microwaves exceeds the threshold for a set period of time.

31. A method in accordance with claim 30 wherein:

the light reflective cavity is external to the housing.

32. A method in accordance with claim 17 wherein:

the light reflective cavity is external to the housing.

* * * * *